US009388551B2

(12) United States Patent
Faivre et al.

(10) Patent No.: US 9,388,551 B2
(45) Date of Patent: Jul. 12, 2016

(54) SHIFT LOGIC FOR GROUND RIPPING MACHINE

(71) Applicant: Caterpillar Inc., Peoria, IL (US)

(72) Inventors: Joseph L. Faivre, Edelstein, IL (US); Matthew A. Johnson, Dunlap, IL (US); Nathaniel S. Doy, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 116 days.

(21) Appl. No.: 14/190,363

(22) Filed: Feb. 26, 2014

(65) Prior Publication Data

US 2015/0240452 A1 Aug. 27, 2015

(51) Int. Cl.

| | |
|---|---|
| ***E02F 5/32*** | (2006.01) |
| ***E02F 9/20*** | (2006.01) |
| ***E02F 3/76*** | (2006.01) |

(52) U.S. Cl.

CPC ..... *E02F 9/2079* (2013.01); *E02F 3/7604* (2013.01); *E02F 5/32* (2013.01); *E02F 9/2066* (2013.01)

(58) Field of Classification Search

USPC ..... 37/447, 449, 907; 172/1, 2, 3, 4, 4.5

See application file for complete search history.

(56) References Cited

U.S. PATENT DOCUMENTS

| | | | | |
|---|---|---|---|---|
| 4,062,539 | A * | 12/1977 | Tetsuka et al. | 172/12 |
| 5,219,411 | A * | 6/1993 | Yamamoto et al. | 180/197 |
| 5,462,122 | A * | 10/1995 | Yamamoto et al. | 172/2 |
| 5,564,507 | A * | 10/1996 | Matsushita et al. | 172/3 |
| 5,996,701 | A * | 12/1999 | Fukasawa et al. | 172/2 |
| 6,131,062 | A * | 10/2000 | Nielsen | 701/50 |
| 7,499,776 | B2 * | 3/2009 | Allard et al. | 701/23 |
| 8,083,004 | B2 | 12/2011 | Knight, Jr. | |
| 8,333,248 | B1 * | 12/2012 | Sulzer | 172/4 |
| 2008/0243345 | A1 * | 10/2008 | Knight | 701/50 |
| 2009/0199441 | A1 * | 8/2009 | Jorgensen et al. | 37/455 |
| 2012/0130601 | A1 * | 5/2012 | Banerjee et al. | 701/50 |
| 2012/0267128 | A1 * | 10/2012 | Shintani et al. | 172/1 |

* cited by examiner

*Primary Examiner* — Thomas Tarcza
*Assistant Examiner* — Richard Goldman
(74) *Attorney, Agent, or Firm* — Jeff A. Greene; Caterpillar Inc.

(57) ABSTRACT

A control system for a machine equipped with a ripping tool. The control system includes a first operator input for generating a ripping control signal that initiates an auto-ripping mode. A second operator input is provided for generating a speed select signal for changing the transmission output speed of the machine to a selected transmission output speed. The system further includes a controller with a memory. The controller is linked to the first and second operator inputs. The controller is programmed to receive a ripping control signal from the first operator input and to activate the auto-ripping mode or auto-ripping mode and deactivate the auto-shift mode. The controller is also programmed to receive a speed select signal from the second operator input and to deactivate the auto-ripping mode and adjust the power source to the selected transmission output speed.

20 Claims, 3 Drawing Sheets

SHIFT LOGIC FOR GROUND RIPPING MACHINE

BACKGROUND

1. Technical Field

Disclosed herein is a shift logic for a ground ripping machine that enables the controller of the machine to shift the machine from an auto-shift mode, where the operator selects a desired gear or speed, to an auto-ripping mode, which requires a downshift to a low or first gear and operation at a high throttle setting, and vice versa.

2. Description of the Related Art

Mobile excavation machines, such as dozers, agricultural tractors, and scrapers, often include one or more ripping tools for cultivating, digging, ripping or otherwise disturbing a ground surface. The ground surface may include non-homogenous loose soil or compacted material that can be easy or difficult for the machine to process. As the machines traverse a site that has changing terrain and/or varying ground surface conditions, the magnitude of resistance applied to the ripping tool can vary greatly. In order to ensure that a maximum productivity of the machine is achieved without damaging the machine, the operator of the machine must continuously alter settings of the machine and the ripping tool to accommodate the changing terrain and ground surface conditions. This continuous altering can be tiring for even a skilled operator and difficult, if not impossible, for a novice operator to achieve optimally.

One way to efficiently accommodate changes in terrain and surface composition may include automatically controlling the machine during portions of the excavation process. An automatically controlled machine is disclosed in US2012267128. This published application discloses an automated control of the ripping tool wherein, if one or more criteria are met that indicate the ripping operation has ended, the ripping tool is automatically pulled upward and tilted to a default position. The automated return of the ripping tool to the default position saves the operator from operating two different levers used to position the ripping tool while contemporaneously steering and operating other components of the machine.

Some machines may be equipped with automatic ripping control mode ("auto-ripping mode"), which is a feature that automates the raising and lowering of the ripping tool and adjusts the throttle to optimize the ripping operation. Normally, auto-ripping modes require the transmission of the machine to be in a low or first gear and the throttle is set to a high setting or full throttle. Another feature offered on some machines is an automatic shift mode ("auto-shift mode"), which is a shift control algorithm that allows the operator to select a desired machine speed, which may be a maximum allowable transmission output speed for the machine. In auto-shift mode, the controller may be programmed to automatically adjust the throttle and transmission gear to achieve an appropriate transmission output speed for the current load on the machine that is less than or equal to the desired machine speed.

Although such automated control systems may improve machine efficiency and reduce operator fatigue by automating some of the functions normally controlled by the operator, the benefits are limited because it is difficult to change the operation of the machine from an auto-ripping mode to an auto-shift mode and vice versa. Specifically, to go from an auto-shift mode to an auto-ripping mode, the transmission must be shifted to a low or first gear and the throttle increased to full throttle or near full throttle. Conversely, to go from an auto-ripping mode to an auto-shift mode, the operator must enter a desired speed, the throttle must be reduced and the transmission shifted to the appropriate gear based on the speed entered by the operator and the load imposed on the machine. Further, the operator must re-enter the desired speed every time the machine is shifted from an auto-ripping mode to an auto-shift mode.

The present disclosure is directed to overcoming one or more of the shortcomings set forth above.

SUMMARY OF THE DISCLOSURE

In one aspect, a control system for a machine is disclosed. The machine has a power source, a transmission and a throttle. The power source may be coupled to the transmission that may include a plurality of gears, including a low gear. The machine may further include a ripping tool. The disclosed system may include a first operator input for generating a ripping control signal for shifting the machine into an auto-ripping mode. The system may further include a second operator input for generating a speed select signal for changing a transmission output speed to a selected transmission output speed in an auto-shift mode. The system may further include a controller having a memory. The controller may be linked to the first and second operator inputs. The controller may be programmed to receive the speed select signal from the second operator input and to change the transmission output speed to the selected transmission output speed by shifting gears, adjusting the throttle or a combination of the two in the auto-shift mode. The user input may further include a third operator input for generating a shift command for shifting the transmission to a selected gear. The controller may also be programmed to receive the ripping control signal from the first operator input and to activate the auto-ripping mode by changing the selected transmission output speed to a ripping speed by shifting the transmission to the low gear and adjusting the throttle to a high setting. In addition, the controller may be programmed to receive the shift command from the third operator input and to shift the transmission to the selected gear.

In another aspect, a method for shifting between an auto-ripping mode of a machine and an auto-shift mode of the machine is disclosed. The machine may have a power source linked to a transmission and a throttle. The transmission may include a plurality of gears, including a low gear. The method may include generating a speed select signal for changing a transmission output speed to a selected transmission output speed in an auto-shift mode. The method may further include storing the selected transmission output speed in a memory. The method may further include changing the transmission output speed in the auto-shift mode to the selected transmission output speed by shifting gears, adjusting the throttle or a combination of the two. The method may then further include generating a ripping control signal for shifting the machine to an auto-ripping mode by changing the selected transmission output speed to a ripping speed by shifting the transmission to the low gear and adjusting the throttle to a high setting.

In another aspect, a machine is disclosed that may include a power source coupled to a transmission and a throttle. The transmission may include a plurality of gears, including a low gear. The machine may further include a ripping tool and a user interface. The user interface may include a first operator input for generating a ripping control signal for shifting to an auto-ripping mode. The user interface may further include a second operator input for generating a speed select signal for shifting to an auto-shift mode. The controller may have a memory and may be linked to the first and second operator inputs, the throttle and the transmission. The controller may be programmed to receive the speed select signal from the second operator input and to change a current transmission output speed to a selected transmission output speed by shifting gears and/or adjusting the throttle in the auto-shift mode. The controller may further be programmed to receive the ripping control signal from the first operator input and to activate the auto-ripping mode by changing the selected transmission output speed to a ripping speed by shifting the transmission to the low gear and adjusting the throttle to a high setting.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
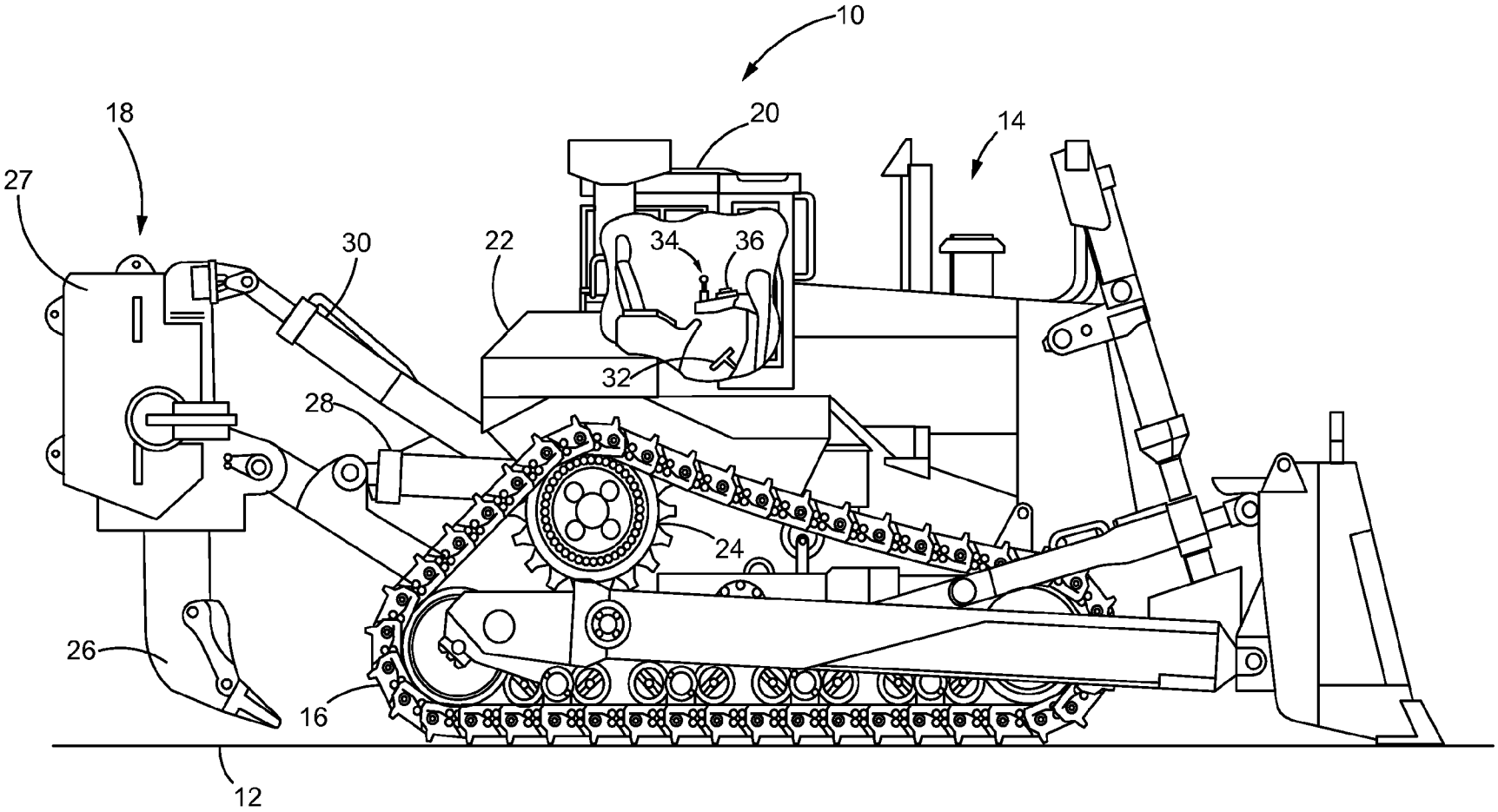
FIG. 1 is a diagrammatic illustration of an exemplary disclosed excavation machine.

FIG. 1 illustrates an exemplary machine 10. The machine 10 may include any mobile machine that performs some type of operation associated with an industry, such as, for example, mining, construction, farming, or any other industry known in the art. For example, the machine 10 may be an earth-moving machine such as a dozer, a loader, a backhoe, an excavator, a motor grader, or any other earth-moving machine. The machine 10 may traverse a work site to manipulate material beneath a work surface 12, e.g. transport, cultivate, dig, rip, and/or perform any other operation known in the art. The machine 10 may include a power source 14 configured to produce mechanical power, a traction device 16, at least one ripping tool 18, and an operator station 20 to house operator controls. It is contemplated that the machine 10 may additionally include a frame 22 configured to support one or more components of the machine 10.

The power source 14 may be any type of internal combustion engine such as, for example, a diesel engine, a gasoline engine, or a gaseous fuel-powered engine. Further, the power source 14 may be a non-engine type of power producing device such as, for example, a fuel cell, a battery, a motor, or another type of power source known in the art. The power source 14 may produce a variable power output directed to the ripping tool 18 and the traction device 16 in response to one or more inputs.

The fraction device 16 may include tracks located on each side of machine 10 (only one side shown) and operatively driven by one or more sprockets 24. The sprockets 24 may be operatively connected to the power source 14 via a transmission 25 to receive power therefrom and drive the traction device 16. Movement of the traction device 16 may propel the machine 10 with respect to the work surface 12. It is contemplated that the traction device 16 may additionally or alternately include wheels, belts, or other traction devices, which may or may not be steerable. It is also contemplated that the traction device 16 may be hydraulically actuated, mechanically actuated, electronically actuated, or actuated in any other suitable manner.

The ripping tool 18 may be configured to lift, lower and tilt relative to the frame 22. For example, the ripping tool 18 may include a shank 26 held in place by a mounting member 27. The shank 26 may penetrate the work surface 12 to disturb or disrupt (i.e., rip) the material below the work surface 12, and may move relative to the mounting member 27. More specifically, the shank 26 may have several configurations or positions relative to the mounting member 27. For example, the shank 26 may be moved higher, lower, away from, and toward the frame 22. The mounting member 27 may be connected to the frame 22 via a linkage system with at least one implement actuator forming a member in the linkage system, and/or in any other suitable manner. For example, a first hydraulic actuator 28 may be connected to lift and lower the ripping tool 18, and a second hydraulic actuator 30 may be connected to tilt the ripping tool 18. It is contemplated that the ripping tool 18 may alternatively include a plow, a tine, a cultivator, and/or any other task-performing device known in the art.

Movement of the ripping tool 18 may correspond to a plurality of predetermined locations and/or orientations (i.e. angle settings of the shank 26). For example, the shank 26 may have a discrete penetration angle and a discrete dig angle that can change based on a material composition of the work surface, a size or capacity of the machine 10, and/or the configuration of the shank 26 relative to the mounting member 27. In one example, the penetration angle of the shank 26 may be vertical relative to the work surface 12 for efficient penetration of the work surface 12. In order to maintain this vertical angle for each of the available shank configurations, the actuators 28, 30 of the mounting member 27 may need to be adjusted based on the current shank 26 configuration. Further, the dig angle of the shank 26 may correspond to a forward tilt of the shank 26 to facilitate efficient digging, while keeping the shank 26 from digging under the machine 10 and forcing material against an underbelly of the machine 10. In order to maintain the shank 26 at the correct digging position relative to the underbelly of the machine 10, the actuators 28, 30 of the mounting member 27 may again need to be adjusted based on the current shank 26 configuration.

Figure 2:
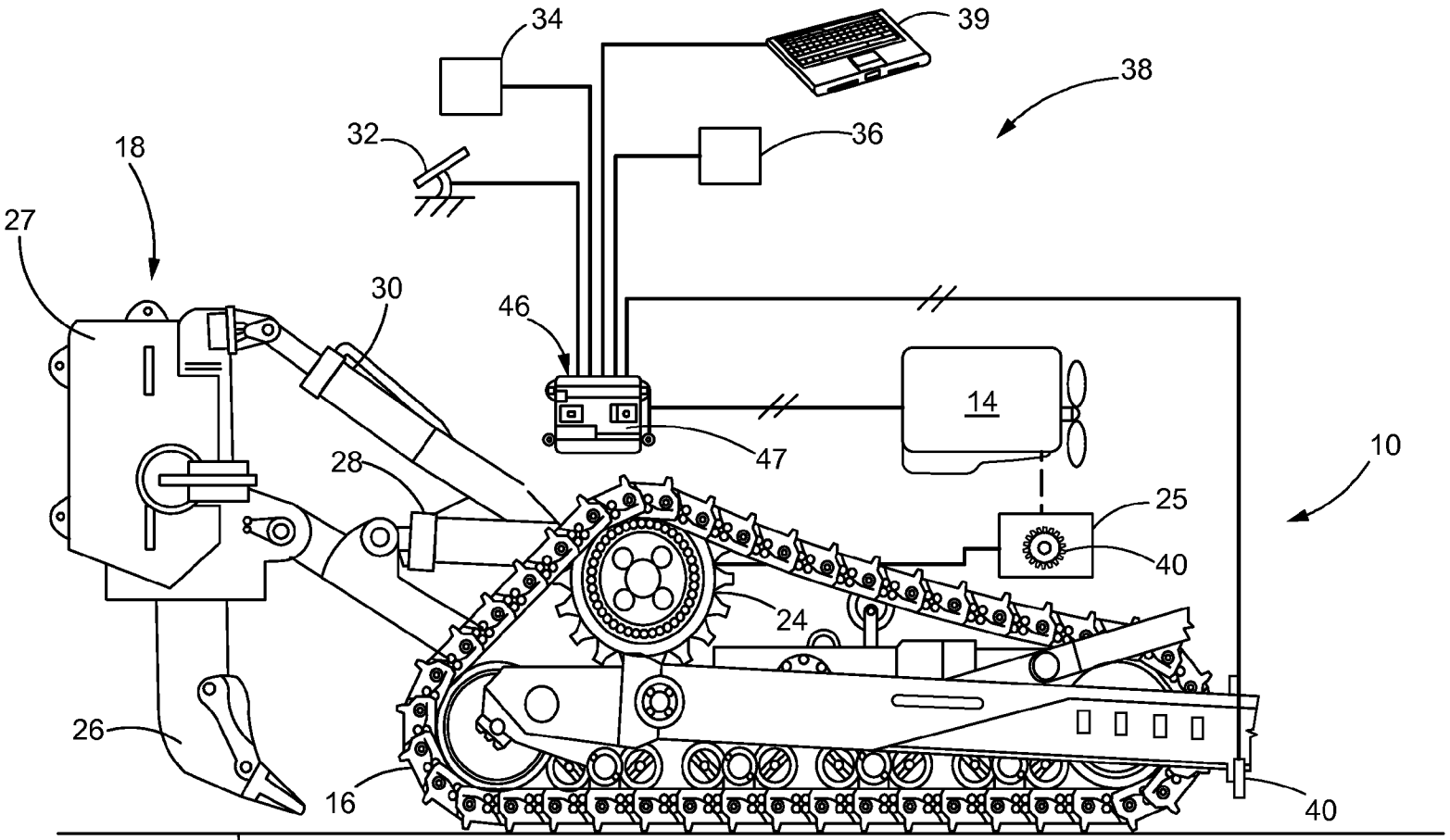
FIG. 2 is a diagrammatic and schematic illustration of an exemplary disclosed control system for use with the machine of FIG. 1.

In an exemplary digging operation, an operator of the machine 10 may set the configuration of the shank 26. For example, while the shank 26 is resting on the ground, a hydraulically actuated pin puller (not shown) may remove a shank pin (not shown) that pivotally couples the shank 26 to mounting member 27 in a first configuration. The operator may then lift or lower the mounting member 27 using the actuator 28 to adjust the configuration of the shank 26 with respect to the mounting member 27 to a second configuration where pin receiving holes (not shown) in the shank 26 and mounting member 27 line up. The pin is then inserted through the aligned holes, typically using the hydraulically actuated pin puller. In another example, the shank 26 may be moveable by a motor, pulley system, or a hydraulic actuator to mechanically slide the shank 26 from the first configuration to the second configuration. It is contemplated that such a mechanism may be controlled electrically or mechanically by the operator and/or the controller 46 (FIG. 2). That is, the operator may set the configuration of the shank 26 by manipulating a switch, a joystick, a button, or any other interface 39 (FIG. 2) known in the art.

The operator may then control the actuators 28, 30 of the mounting member 27 to set the shank 26 to a predetermined penetration angle associated with the current configuration of shank 26. That is, the operator may control the implement actuators 28, 30 of the mounting member 27 to orient the shank 26 at a vertical angle relative to the work surface 12 prior to penetration of the work surface 12. The operator may then control the implement actuators to lower the shank 26 and penetrate the work surface 12. Once the shank 26 has penetrated the work surface 12, the operator may control the actuators 28, 30 of the mounting member 27 to set the shank 26 to a predetermined dig angle for the current configuration of the shank 26. That is, the operator may again control the actuators 28, 30 to set the shank 26 to a dig angle that does not place the shank 26 under the machine 10, yet facilitates efficient digging.

The hydraulic actuators 28, 30 may each include a piston-cylinder arrangement, a hydraulic motor, and/or another known hydraulic device having one or more fluid chambers therein. In a piston-cylinder arrangement, pressurized fluid may be selectively supplied to and drained from one or more chambers thereof to affect linear movement of the actuators 28, 30, as is known in the art. In a hydraulic motor arrangement, pressurized fluid may be selectively supplied to and drained from chambers on either side of an impeller to affect rotary motion of hydraulic actuators 28, 30. Movement of hydraulic actuator 28 may assist in moving the ripping tool 18 with respect to the frame 22 and the work surface 12, particularly down toward and up away from work surface 12. Similarly, movement of the hydraulic actuator 30 may assist in orienting the ripping tool 18 with respect to the frame 22 and the work surface 12, particularly decreasing or increasing the angle of the ripping tool 18 relative to the work surface 12.

As shown in FIG. 2, the operator station 20 may include a throttle 32, a first operator input 34, second operator input 36 and a third operator input 39, which may include the first and second operator inputs 34, 36. Although not shown, it is contemplated that the operator station 20 may additionally include other controls such as, for example, a machine direction control, or any other control device known in the art. The throttle 32 may determine, at least in part, the amount of mechanical power delivered to traction device 16.

FIG. 2 illustrates a control system 38 having components that cooperate to move ripping tool 18 and shift the transmission 25 to a low gear 40 in an auto-ripping mode. The control system 38 may also have components that cooperate to control the speed of the machine 10 during an auto-shift mode. For example, the control system 38 may include the third operator input 39, the first operator input 34, the second operator input 36 and a controller 46. The third operator input 39 may be in the form of a user interface and may include the operator inputs 34, 36 and may further allow an operator to input values relevant to the auto-ripping mode as well as to the auto-shift mode, such as, for example, an operation of the shank 26, throttle 32, and shifting of the transmission 25 by way of a shift control command. It is contemplated that these input values may be delivered to the controller 46 when or shortly after the operator initiates an auto-ripping mode or an auto-shift mode, or when shifting between the two modes.

The controller 46 may embody a single microprocessor or multiple microprocessors that include a means for controlling the machine 10 during an auto-ripping mode or an auto-shift mode. For example, the controller 46 may include a memory 47, a secondary storage device and a processor, such as a central processing unit or any other means for controlling the machine 10 during an auto-ripping mode and/or an auto-shift mode. Numerous commercially available microprocessors can be configured to perform the functions of the controller 46. It should be appreciated that the controller 46 could readily embody a general power source microprocessor capable of controlling numerous power source functions. Various other known circuits may be associated with the controller 46, including power supply circuitry, signal-conditioning circuitry, solenoid driver circuitry, communication circuitry and other appropriate circuitry. It should also be appreciated that the controller 46 may include one or more of an application-specific integrated circuit (ASIC), a field-programmable gate array (FPGA), a computer system and a logic circuit, configured to allow the controller 46 to function in accordance with the present disclosure. Thus, the memory 47 of the controller 46 may embody, for example, the flash memory of an ASIC, flip-flops in an FPGA, the random access memory of a computer system, or a memory circuit contained in a logic circuit. The controller 46 may be further communicatively coupled with an external computer system, instead of or in addition to including a computer system.

The controller 46 may control the movement of ripping tool 18 during an auto-ripping mode, during a shift from an auto-ripping mode to an auto-shift mode or vice versa. To that end, the controller 46 may receive input signals from an operator of the machine 10, monitor signals generated by various sensors, perform one and/or more algorithms to determine appropriate output signals, and deliver the output signals to one or more components of the machine 10 to control the position of the ripping tool 18, shift to the appropriate gear 40 and adjust the throttle 32.

The controller 46 may also control the acceleration and velocity of the traction device 16 in an auto-shift mode by controlling the output speed of the transmission 25. That is, the controller 46 may be communicatively connected to the power source 14 to affect the operation of the power source 14 by reducing or increasing an amount of fuel delivered to the power source 14, changing a timing of fuel injections into the power source 14, and/or reducing an amount of air delivered to the power source 14. It is contemplated that the controller 46 may alternatively control the acceleration of the traction device 16 by directly manipulating the position of the throttle 32.

Further, the control system 38 facilitates shifting between an auto-ripping mode to an auto-shift mode and vice versa with minimal operator input. Specifically, in the auto-ripping mode, the ripping tool 18 is lowered so that the shank 26 has engaged or pierced the surface 12. In the auto-ripping mode, the transmission 25 is shifted to a low gear or a first gear 40 and the throttle 32 is set to a high setting, which may be full throttle or 100% throttle. However, in an auto-shift mode, the operator has selected a desired speed and the controller 46 determines the appropriate gear of the transmission 25 and the throttle 22 setting to accomplish the desired speed, given the load being imposed on the machine 10. Thus, in prior art systems, to shift from the auto-ripping mode to the auto-shift mode, the throttle 32 must be reduced to a lower setting and the transmission 25 is shifted from the low or first gear 40 to the appropriate gear for the desired transmission output speed. Some systems may even require the operator to raise the ripping tool 18 when switching from an auto-ripping mode to an auto-shift mode. Conversely, to change or shift from the auto-shift mode back to the auto-ripping mode in a prior art system, shifting of the transmission 25 and one or more adjustments to the throttle 32 are required. The disclosed control system 38 and controller 46 enable the shifting back and forth between the auto-ripping mode and the auto-shift mode to be accomplished with minimal operator input. The disclosed control system 38 and controller 46 may also enable the operator to enter a shift command via the third operator input 39 to shift out of either the auto-ripping mode or the auto-shift mode to a desired gear.

Figure 3:
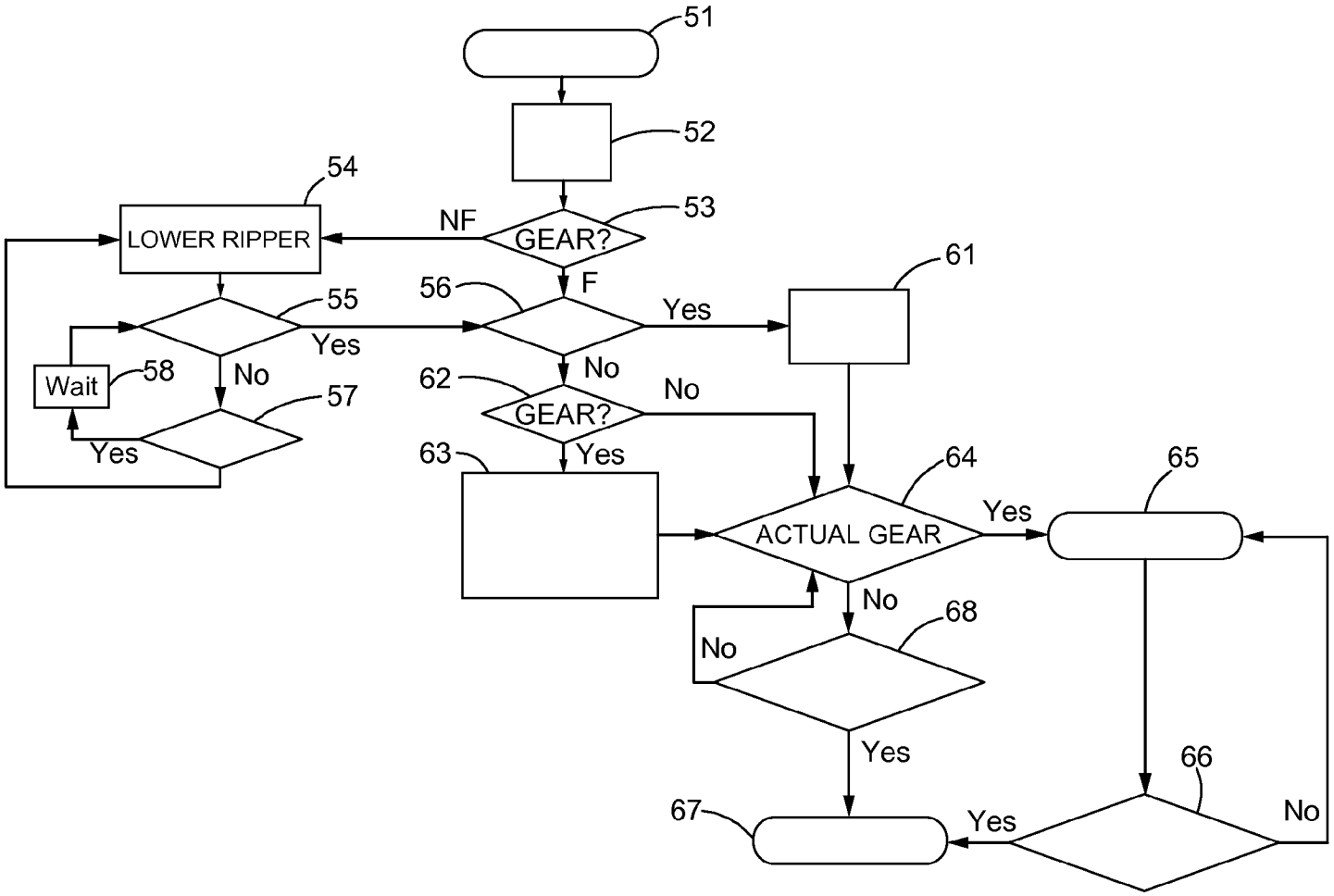
FIG. 3 is a flow chart depicting an exemplary disclosed method of operation associated with the control system shown in FIG. 2.

FIG. 3 schematically illustrates how the control system 38 and controller 46 accomplish a practically seamless transition between the auto-ripping mode and auto-shift mode. First, in part 51, the first operator input 34 (FIG. 2) is pressed or otherwise engaged resulting in the initiation of the auto-ripping mode. At part 52, the auto-ripping mode status is changed to active. In certain circumstances, intervening events such as a signal from the second operator input 36 or a second signal from the first operator input 34 can cause the status of the auto-ripping mode to be changed to "suspended." At part 53, the controller 46 determines which gear the transmission 25 is in. If the transmission 25 is in either neutral or reverse, the ripping tool 18 is lowered at part 54. In order to enter the auto-ripping mode, the operator must enter a command to shift the transmission 25 to forward at part 55. If a forward command is provided by the operator, the controller checks to see that the auto-ripping mode is activated at part 56. If a forward command has not been entered, the position of the ripping tool 18 is checked at part 57. Specifically, the controller 46 determines whether the ripping tool 18 is at a maximum extension or whether a maximum time for lowering the ripping tool 18 has been reached at part 57. If the ripping tool 18 has been fully lowered or a time out has been reached at part 57, the system waits for a predetermined time period at part 58 prior to rechecking whether the operator has shifted the transmission 25 to a forward setting in part 55. If the ripping tool 58 has not been fully lowered or a time period for lowering the ripping tool 18 has not expired at part 57, the ripping tool 18 continues to be lowered as the system returns to part 54 as shown in FIG. 3.

As noted above, when the operator has entered a forward command at part 55, the system checks to see whether the auto-ripping mode is active at part 56. To be active, the auto-ripping mode requires that the transmission 25 be in a low or a first gear. If the auto-ripping mode is active at part 56, the controller requests a high idle throttle setting at part 61. Further, it will be noted that any previously entered desired speed setting is stored in the memory 47 of the controller 46. That is, when the system shifts out of the auto-ripping mode and back to an auto-shift mode, the system automatically reverts to the previously selected desired transmission output speed setting that was entered by the operator when the system was in the auto-shift mode.

Still referring to FIG. 3, if the auto-ripping mode is not active in part 56, the controller 46 determines the actual gear at part 62 and commands the transmission to shift to the low or first gear using a normal shift logic at part 63. While many auto-ripping modes require the transmission 25 to be in a first or lowest gear 40, some machines 10 may operate in an auto-ripping mode in a higher gear. Thus, at part 63, both the actual and desired gear settings are the same, e.g. first or lowest gear, or the appropriate gear for the particular machine 10. At part 64, the controller 46 checks to see if the actual gear is the appropriate gear for the auto-ripping mode. If the transmission 25 is in the correct gear for the auto-ripping mode, the auto-ripping mode is in active control at part 65 and a ripping operation may be undertaken.

To get out of the auto-ripping mode, the operator may do one of three things at part 66. First, the operator may command a manual shift of the transmission 25 via the third operator input 39; the operator may enter a new desired speed for an auto-shift operation via the second operator input 36; or the operator may also engage the first operator input 34 to turn off auto-ripping mode. If a gearshift or a desired speed change is entered by the operator at part 66, the controller 46 allows the transmission 25 to return to normal operation and the auto-ripping mode is deactivated at part 67. If the operator does nothing, the system loops back to part 65 from part 66 and the auto-ripping mode remains in active control. If the actual gear at part 64 is not the appropriate gear for the auto-ripping mode, the controller 46 checks to see whether a maximum time limit has been reached at part 68 and, if the time limit has been reached, the transmission is allowed to return to normal operation and the auto-ripping mode is deactivated at part 67. If the time limit has not been reached at part 68, the system loops back to part 64 and continues to attempt to enter the auto-ripping mode.

Thus, the control system 38 may be shifted from auto-ripping mode to an auto-shift mode by the operator simply entering a manual gearshift command or a new desired transmission output speed at part 66, both of which result in the control system 38 returning to the auto-shift mode at part 67. To shift from the auto-shift mode to the auto-ripping mode, the operator merely needs to engage or otherwise activate the first operator input 34 or enter a suitable command through the user interface 39.

INDUSTRIAL APPLICABILITY

The machine 10 and a control system 38 are disclosed that facilitate the shifting between an auto-ripping mode of the machine 10 and an auto-shift mode of the machine 10. The system carries out a method wherein the machine 10 is in an auto-shift mode and the operator enters a speed select signal via the second user input 36 that changes the transmission output speed to a selected or desired transmission output speed. The selected or desired transmission output speed is stored in the memory 47 of the controller 46. The controller 46 manipulates the throttle 32 and the transmission 25 to change the transmission output speed to the selected transmission output speed. To enter the auto-ripping mode, the operator generates a ripping control signal via the first operator input 34 or the user interface 39. The ripping control signal received at the controller 46 generates an activation of the auto-ripping mode by changing the selected transmission output speed to an appropriate ripping speed by shifting the transmission to a low or first gear and adjusting the throttle to a high setting. To revert back to normal or auto-shift mode, the operator may either enter in a new selected transmission output speed via the second user input 36 or user interface 39 or the operator may enter an instruction for a manual gear shift or the operator may press the auto-rip button or the first operator input 34 to turn the auto-ripping mode off.

As a result, the operation of a complex machine like the machine 10 shown in FIG. 1 is simplified by facilitating the transition between an auto-ripping mode and an auto-shift mode or a normal operation of the transmission, thereby deactivating the auto-ripping mode.

What is claimed:

1. A control system for a machine having a power source and a throttle, the power source coupled to a transmission that includes a plurality of gears including a low gear, the machine further having a ripping tool, the system comprising:

a first operator input for generating a ripping control signal for an auto-ripping mode;

a second operator input for generating a speed select signal for changing a transmission output speed to a selected transmission output speed;

a controller having a memory, the controller linked to the first and second operator inputs, the controller programmed to receive the speed select signal from the second operator input and to change the transmission output speed to the selected transmission output speed by at least one of shifting gears and adjusting the throttle, and the controller programmed to receive the ripping control signal from the first operator input and to activate the auto-ripping mode by changing the selected transmission output speed to a ripping speed by shifting the transmission to the low gear and adjusting the throttle to a high setting.

2. The system of claim 1 further including a third operator input that generates shift commands, wherein, when the system is operating in auto-ripping mode and the third operator input is engaged, the third operator input generates a shift command for a selected gear, the controller is programmed to receive the shift command for the selected gear from the third operator input and to deactivate the auto-ripping mode by changing the ripping speed by shifting the transmission to the selected gear and adjusting the throttle.

3. The system of claim 1 wherein the controller is programmed to store the selected transmission output speed in the memory.

4. The system of claim 1 wherein, when the auto-ripping mode is activated, the controller is programmed to receive another speed select signal from the second operator input including a new selected transmission output speed, to deactivate the auto-ripping mode, and to adjust the power source to the new selected transmission output speed by at least one of shifting gears and adjusting the throttle.

5. The system of claim 1 wherein the high setting is full throttle.

6. The system of claim 1 wherein, when the first operator input is engaged the auto-ripping mode is activated and an auto-shift mode has not been deactivated, the first operator input sends a deactivation signal to the controller and the controller deactivates the auto-ripping mode and returns the power source to the selected transmission output speed.

7. The system of claim 6 wherein the controller further returns the power source to the selected transmission output speed by at least one of shifting gears and adjusting the throttle.

8. The system of claim 1 wherein, when the second operator input is engaged without selecting a new selected transmission output speed while the auto-ripping mode is activated, the controller deactivates the auto-ripping mode and returns the machine to the selected transmission output speed.

9. The system of claim 8 wherein, after the controller deactivates the auto-ripping mode, the controller returns the power source to the selected transmission output speed by at least one of shifting gears and adjusting the throttle.

10. A method for shifting between an auto-ripping mode of a machine and an auto-shift mode of the machine, the machine having a power source and a throttle, the power source coupled to a transmission that includes a plurality of gears including a low gear, the method comprising:

generating a speed select signal for changing a transmission output speed to a selected transmission output speed;

storing the selected transmission output speed in a memory;

changing the transmission output speed to the selected transmission output speed by at least one of shifting gears and adjusting the throttle;

generating a ripping control signal for an auto-ripping mode;

activating the auto-ripping mode by changing the selected transmission output speed to a ripping speed by shifting the transmission to the low gear and adjusting the throttle to a high setting.

11. The method of claim 10 further including generating a shift command for shifting the transmission of a selected gear;

deactivating the auto-ripping mode; and shifting the transmission to the selected gear by at least one of shifting gears and adjusting the throttle.

12. The method of claim 10 further including generating another speed select signal a new selected transmission output speed;

deactivating the auto-ripping mode; and adjusting the power source to the new selected transmission output speed by at least one of shifting gears and adjusting the throttle.

13. The method of claim 10 wherein the high setting is full throttle.

14. The method of claim 10 wherein the low gear is a first gear.

15. The method of claim 10 wherein the memory is part of a controller.

16. The method of claim 10 wherein the speed select and ripping control signals are transmitted to a controller that is linked to the transmission and the throttle and wherein the controller is programmed to adjust the throttle and shift the gears in response to receiving speed select and ripping control signals.

17. A machine comprising:

a power source and a throttle, the power source coupled to a transmission that includes a plurality of gears including a low gear;

a ripping tool;

a user interface including a first operator input for generating a ripping control signal for an auto-ripping mode, the user interface further including a second operator input for generating a speed select signal for changing a transmission output speed to a selected transmission output speed, the user interface further including a third operator input for generating a shift command for shifting the transmission to a selected gear;

a controller having a memory, the controller linked to the first, second and third operator inputs, the throttle and the transmission, the controller programmed to receive the speed select signal from the second operator input and to change the transmission output speed to a selected transmission output speed by at least one of shifting gears and adjusting the throttle, the controller programmed to receive the shift command signal from the third operator input and to shift the transmission to a selected gear, the controller further programmed to receive the ripping control signal from the first operator input and to activate the auto-ripping mode by changing the selected transmission output speed to a ripping speed by changing the selected gear to the low gear by shifting the transmission to the low gear and adjusting the throttle to a high setting.

18. The machine of claim 17 wherein the controller is programmed to store the selected transmission output speed in the memory, and the user interface for deactivating the auto-ripping mode and returning the power source to the selected transmission output speed by at least one of shifting gears and adjusting the throttle.

19. The machine of claim 17 wherein, when the auto-ripping mode is activated, the controller is programmed to receive a speed select signal from the second operator input, to deactivate the auto-ripping mode, and to adjust the power source to the selected transmission output speed by at least one of shifting gears and adjusting the throttle.

20. The machine of claim 19 wherein, when the auto-ripping mode is activated, the controller is programmed to receive a shift command from the third operator input, and to deactivate the auto-ripping mode, and to shift the transmission to the selected gear.

* * * * *